US006668870B2

(12) United States Patent
Rossum et al.

(10) Patent No.: US 6,668,870 B2
(45) Date of Patent: Dec. 30, 2003

(54) MANUALLY OPERATED WIRE TWISTING AND TYING TOOL AND METHOD OF TWISTING AND TYING THE WIRES TOGETHER

(75) Inventors: Eugene C. Rossum, Alexandria, MN (US); Gerald L. Johnson, Carthage, MO (US); Gregg Eugene Weeks, Claremont, CA (US); Brady L. Mork, Brandon, MN (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 10/147,895

(22) Filed: May 20, 2002

(65) Prior Publication Data

US 2003/0213526 A1 Nov. 20, 2003

(51) Int. Cl.[7] ..... B21F 15/04

(52) U.S. Cl. ..... 140/118; 140/93.6

(58) Field of Search ..... 140/93.6, 117, 140/118, 119, 120, 122

(56) References Cited

U.S. PATENT DOCUMENTS

| | | | | | |
|---|---|---|---|---|---|
| 1,050,401 | A | * | 1/1913 | Steele | 140/117 |
| 1,211,478 | A | * | 1/1917 | Muir | 140/118 |
| 1,494,257 | A | * | 5/1924 | Krueger | 140/119 |
| 5,921,289 | A | | 7/1999 | Johnson | |
| 6,009,646 | A | | 1/2000 | Johnson | |

* cited by examiner

*Primary Examiner*—Lowell A. Larson
(74) *Attorney, Agent, or Firm*—Schwartz & Weinrieb

(57) ABSTRACT

A manually-operated baling wire twisting and tying tool, and a method of twisting and together the wires together, comprises a first handle having a first wire-twisting implement mounted therein, and a second handle having a second wire-twisting implement mounted therein. An axially oriented slot is effectively defined within the tool throughout substantially the entire axial extent thereof for accommodating the wires, and when the first and second handles, having the first and second wire-twisting implements disposed therein, are rotated with respect to each other, the wires are twisted and tied together. A visually indicating mechanism is also provided upon the tool for indicating to the operator when a predetermined number of twists have been imparted to the wires.

21 Claims, 3 Drawing Sheets

MANUALLY OPERATED WIRE TWISTING AND TYING TOOL AND METHOD OF TWISTING AND TYING THE WIRES TOGETHER

FIELD OF THE INVENTION

The present invention relates generally to manually operated tools and a method of using the same, and more particularly to a new and improved manually operated wire twisting and tying tool which is especially useful in connection with the twisting and tying together of the free end portions of baling wire used in connection with the binding of baled products so as to secure the same in a compacted or compressed state or condition.

BACKGROUND OF THE INVENTION

Various types of loose material or packaging components are often processed and distributed in the form of compressed or compacted bales so that a greater amount or number of such loose material or packaging components may be stored or shipped within a smaller space. In addition, it is easier and more efficient to handle bales of material or packaging components than to handle the loose material or individual packaging components. When the loose material or packaging components are compressed or compacted into bales, it is generally known to wrap and tie such bales with wire or other similar binding devices or members so as to secure and maintain the bales in their compressed or compacted form while being stored or shipped. Wire is the most preferable binding device due to its low cost and ease of handling and manipulation. One method of conventionally forming a compressed or compacted bale of material or components, and of subsequently securing and maintaining the same in its compressed or compacted state, comprises the steps of depositing the compressible material or components into an automatic baler wherein the material or components are compacted or compressed into a bale by means of a suitable ram mechanism, and subsequently, the bale is conducted through a plurality of spaced wire wrapping stations such that a plurality of wire strands are wrapped around the bale at different locations thereof.

In order to secure together the free end portions of the wire strands wrapped around the bale of material or components, automatic wire twisting and tying apparatus have been used in conjunction with, or as integral parts of, the automatic baler apparatus, however, such automatic apparatus have proven relatively complex in structure, large and bulky in size, and expensive to manufacture. In addition, it is known that, due to the stresses impressed upon and inherent within the baling wires as a result of the wrapping of the same around the compressed or compacted bale of material or components, one of the major difficulties, which is uniquely problematic in connection with the tying together of the free end portions of the baling wire wrapped around the bale of material or components, comprises the fact that the free end portions of the baling wire normally tend to separate from each other. It is imperative, however, that the free end portions of the baling wire are maintained together in an overlapped state both before and during the twisting together of the free end portions of the baling wire in order to define or achieve the ultimately desired knotted structure which terminates the wrapped baling wire and maintains the wrapped baling wire in its secured state or condition upon the bale of material or components. Unfortunately, such automatic machines or mechanisms have not always been able to adequately address this problem or difficulty which has therefore rendered such automatic machines or mechanisms difficult and tedious to use.

In order to reduce the complexities and costs involved in connection with the use of automatic wire twisting and tying apparatus, hand tying techniques have also been employed within the industry. One known hand tying technique comprises the formation of a pre-wound loop upon a first end portion of the baling wire, the insertion of the second end portion of the baling wire through such pre-wound loop, and the twisting of the non-looped end portion of the baling wire around itself. This technique, however, has exhibited several operational problems which have rendered the same undesirable. For example, the termination tie is often inconsistent, leading to an imbalance in the stress levels accommodated by each end portion of the baling wire. In addition, such termination tie has often proven to be insufficiently strong due to poor quality levels characteristic of the twists formed within the termination tie. Accordingly, once the bale is removed from the baler apparatus, the failure of the tie leads to a failure of the bale and the need to reprocess the same. As a result, the industry has not enthusiastically embraced the use of such hand tying techniques and has subsequently adopted the use of manually operated tying devices or mechanisms.

One example of such manually operated tying devices or mechanisms is disclosed within U.S. Pat. No. 5,921,289 which issued to Johnson on Jul. 13, 1999. In accordance with the teachings and description of such patent, and as disclosed within FIG. 1, which substantially corresponds to FIG. 1 of the noted patent, it is briefly noted that the manually operated baling wire tying device or mechanism of Johnson is generally indicated by the reference character 10 and is seen to comprise upper and lower housing sections 12*a*,12*b*. Each one of the upper and lower housing sections 12*a*,12*b* comprises a cross-bar section 17, and a pair of legs 16*a*,16*b* project forwardly from each one of the cross-bar sections 17. The legs 16*a*,16*b* are respectively provided with semi-cylindrical openings 21 for respectively housing bearing members 28 which in turn have hub portions 22 of twister gears 18*a*,18*b* rotatably disposed therein. Twister pinions 20*a*,20*b* are respectively fixedly mounted within the twister gears 18*a*,18*b* so as to be rotatable therewith, and a cover 34 and a locking structure 36 are operatively associated with each one of the twister gear and pinion assemblies 18*a*,20*a* and 18*b*,20*b*. The outer covers 34, locking structures 36, bearing members 28, twister gears 18*a*,18*b*, and twister pinions 20*a*,20*b* are all individually provided with a radial slot so as to form together a collective slot 55 into which a pair of wires, to be twisted together, can be inserted.

The twister gears 18*a*,18*b* comprise bevel gears, with the teeth thereof being illustrated at 25, and a beveled drive gear 40, having teeth 42 integrally formed thereon, is effectively interposed between the twister gears 18*a*,18*b* such that the twister gears 18*a* and 18*b* are engaged with diametrically opposed regions of the drive gear 40. The beveled drive gear 40 is operatively connected to a drive shaft 50, and drive shaft 50 is fixedly connected to a crank handle 52. Accordingly, when the crank handle 52 is rotated in a predetermined direction, such as, for example, in the clockwise direction as viewed from the front of the device or mechanism 10 and oriented along the axis of the beveled drive gear 40, the latter is likewise rotated in the clockwise direction. Therefore, twister gear 18*a*, and its twister pinion 20*a*, will be rotated in the counterclockwise direction, as viewed along their respective axes and in the direction extending from the axially inner end of twister pinion 20*a* to the axially outer end of the hub portion 22 of twister gear 18*a*, while twister gear 18*b* and its twister pinion 20*b* will be rotated in the clockwise direction, as viewed along their respective axes and in the same direction as was used in connection with twister gear and pinion gear 18*a*,20*a*. Accordingly, since the twister gears 18*a*,18*b* and twister pinions 20*a*,20*b* are rotated in opposite directions, the wire end portions of the baling wire, which are disposed within the twister pinions 20*a*,20*b*, are effectively twisted with respect to each other around an axis which is common to such wire end portions and which extends along the common slot 55 so as to form a twisted termination knot.

While the aforenoted baling wire twisting and tying apparatus operates satisfactorily, it is noted that the apparatus is nevertheless relatively complex and bulky in structure. In addition, while the same is manually operable, the apparatus does not comprise relatively simple structure comprising a relatively small size which would in fact enable an operator to readily hold or grasp the same in his or her hands while subsequently manipulating the apparatus in a relatively simple manner. Accordingly, a need exists in the art for a new and improved manually operated baling wire twisting and tying tool which is relatively simple in structure, and which is of such relatively small size as to readily enable the same to be held by an operator and easily manipulated for the performance of a baling wire twisting and tying operation.

OBJECTS OF THE INVENTION

Accordingly, it is an object of the present invention to provide a new and improved manually-operated baling wire twisting and tying tool or apparatus.

Another object of the present invention is to provide a new and improved manually-operated baling wire twisting and tying tool or apparatus which effectively overcomes the various operational drawbacks and disadvantages characteristic of PRIOR ART baling wire twisting and tying tools or apparatus.

An additional object of the present invention is to provide a new and improved manually-operated baling wire twisting and tying tool or apparatus which is relatively simple in structure and which is also relatively small in size.

A further object of the present invention is to provide a new and improved manually-operated baling wire twisting and tying tool or apparatus which is relatively simple in structure and which is relatively small in size so as to permit an operator to readily grasp and hold the same and thereby in turn readily permit the operator to simply perform a baling wire twisting and tying operation.

A last object of the present invention is to provide a new and improved manually-operated baling wire twisting and tying tool or apparatus which is relatively simple in structure and which is relatively small in size so as to permit an operator to readily grasp and hold the same and thereby in turn readily permit the operator to simply perform a baling wire twisting and tying operation whereby the resulting twisted and tied or knotted end portions of the baling wire will exhibit uniform consistency, will exhibit sufficient strength in order to withstand the various stresses inherently impressed thereon by means of the compressed or compacted bale of material or components, and will not tend to unravel as is often characteristic of hand-twisted and tied or knotted end portions of baling wire wrapped around the bale of material or components.

SUMMARY OF THE INVENTION

The foregoing and other objectives are achieved in accordance with the teachings and principles of the present invention through the provision of a new and improved manually-operated baling wire twisting and tying tool or apparatus which comprises an axially elongated hand-held device comprising an axially central main housing section, a first wire-twisting housing section or handle having a first wire-gripping mechanism fixedly mounted therein, and a second wire-twisting housing section or handle having a second wire-gripping mechanism fixedly mounted therein. The first wire-twisting housing section or handle is fixedly mounted upon a first end of the axially central main housing section such that the first wire-gripping mechanism extends into the first end of the axially central main housing section, and the second wire-twisting housing section or handle is rotatably mounted upon a second opposite end of the axially central main housing section such that the second wire-gripping mechanism extends into the second end of the axially central main housing section. The first wire-twisting housing section or handle is provided with a radially inwardly extending slot oriented in a radial plane perpendicular to the longitudinal axis of the hand-held device so as to permit the pair of wires, which are to be twisted together, to be inserted into the device, and an axially oriented slot extending substantially the entire axial extent or longitudinal length of the device for accommodating the wires in preparation for the performance of the wire twisting and tying operation. An end cap is rotatably mounted upon the second wire-twisting housing section or handle so as to effectively close the second axial end of the device and thereby prevent the wires from being inadvertently disengaged from the axially oriented slot once the wires are disposed within the axially oriented slot, whereupon rotational movement of the second wire-twisting housing section or handle, having the second wire-gripping mechanism fixedly mounted therein, relative or with respect to the first wire-twisting housing section or handle, having the first wire-gripping mechanism fixedly mounted therein, the wires are twisted and tied together. Upon completion of the wire twisting and tying operation, the end cap is rotated in the reverse direction so as to effectively open the second axial end of the device, and the twisted and tied-together wires can then be removed from the axially oriented radially inwardly extending slots. The device is then ready for use in connection with a subsequent pair of wires to be twisted and tied together.

BRIEF DESCRIPTION OF THE DRAWINGS

Various other objects, features, and attendant advantages of the present invention will be more fully appreciated from the following detailed description when considered in connection with the accompanying drawings in which like reference characters designate like or corresponding parts throughout the several views, and wherein.

DETAILED DESCRIPTION OF THE PREFERRED EMBODIMENT

Figure 3:
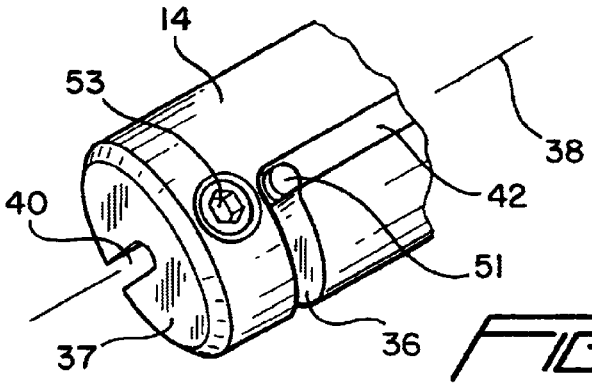
FIG. 3 is an enlarged view of the encircled area A as noted upon FIG. 2 showing in greater detail the radially oriented wire insertion and axially oriented wire accommodation slots as formed within the non-rotatable end of the new and improved manually-operated wire twisting and tying tool of the present invention.
Figure 2:
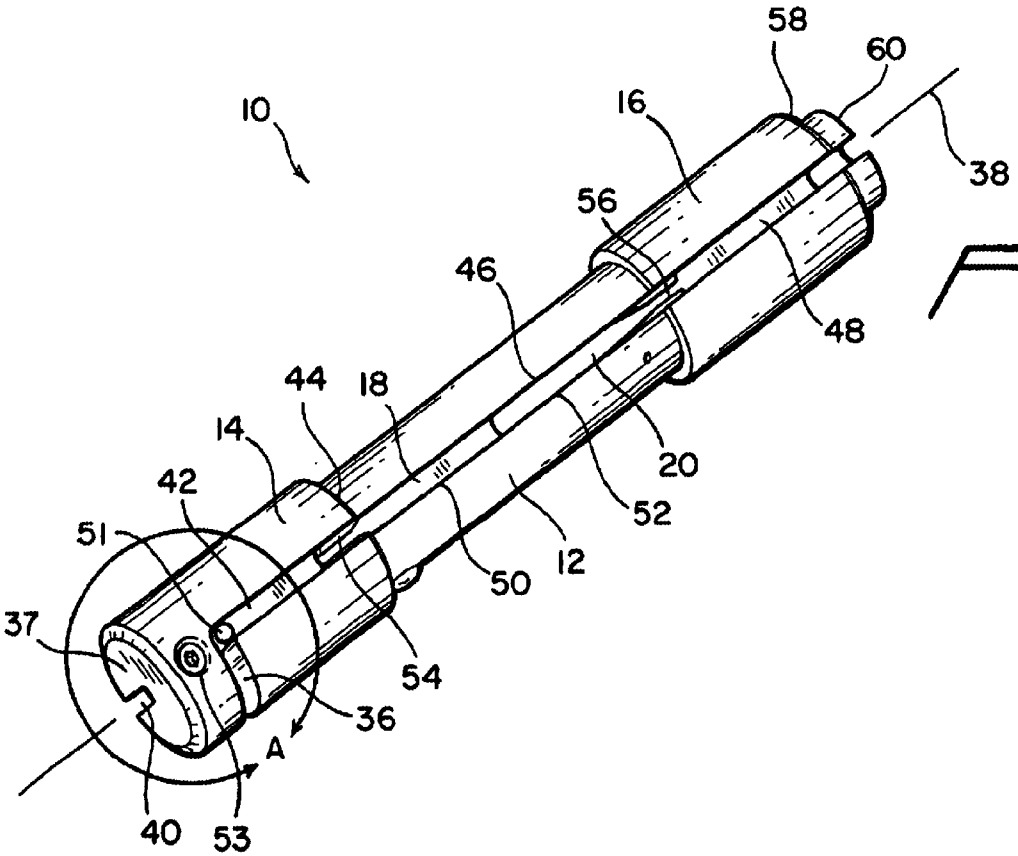
FIG. 2 is a perspective view of the new and improved manually-operated wire twisting and tying tool or device constructed in accordance with the teachings and principles of the present invention and showing the cooperative parts thereof.

Referring now to the drawings, and more particularly to FIGS. 2 and 3 thereof, the new and improved manually operated wire twisting and tying tool or device, as constructed in accordance with the principles and teachings of the present invention and showing the cooperative parts thereof, is illustrated and is generally indicated by the reference character 10. More particularly, the manually-operated wire twisting and tying tool or device 10 of the present invention is seen to having a substantially axially elongated cylindrical configuration comprising an axially central main tubular housing or support section 12, a first wire-twisting housing section or handle 14 which is effectively fixed upon or within a first axial end of main tubular housing or support section 12, and a second wire-twisting housing section or handle 16 which is effectively rotatably mounted upon or within a second axial end of main tubular housing or support section 12. A first wire-gripping mechanism or implement 18 is fixedly mounted within the first wire-twisting housing section or handle 14 whereby the first wire-gripping mechanism or implement 18 is fixed with respect to both the first wire-twisting housing section or handle 14 and main tubular housing or support section 12, and a second wire-gripping mechanism or implement 20 is correspondingly fixedly mounted within the second wire-twisting housing section or handle 16 whereby the second wire-gripping mechanism or implement 20 is therefore rotatable, along with the second wire-twisting housing section or handle 16, with respect to main tubular housing or support section 12, first wire-twisting housing section or handle 14, and first wire-gripping mechanism or implement 18.

Figure 4:
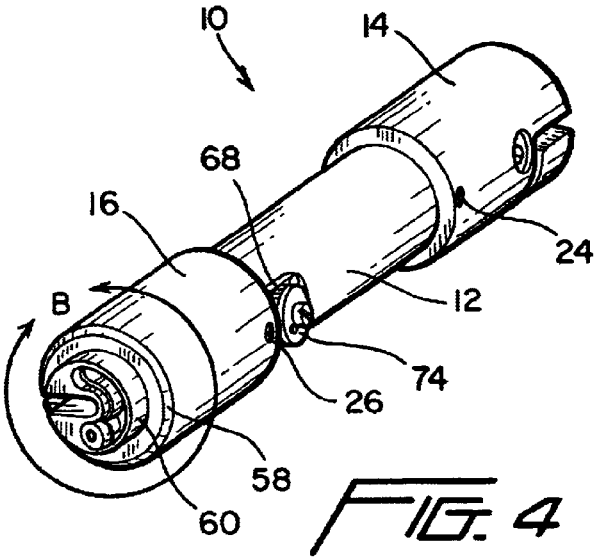
FIG. 4 is a perspective view similar to that of FIG. 2 showing, however, the new and improved manually-operated wire twisting and tying tool or device as viewed from the rotatable end of the tool or device of the present invention and showing the cooperative parts thereof.
Figure 6:
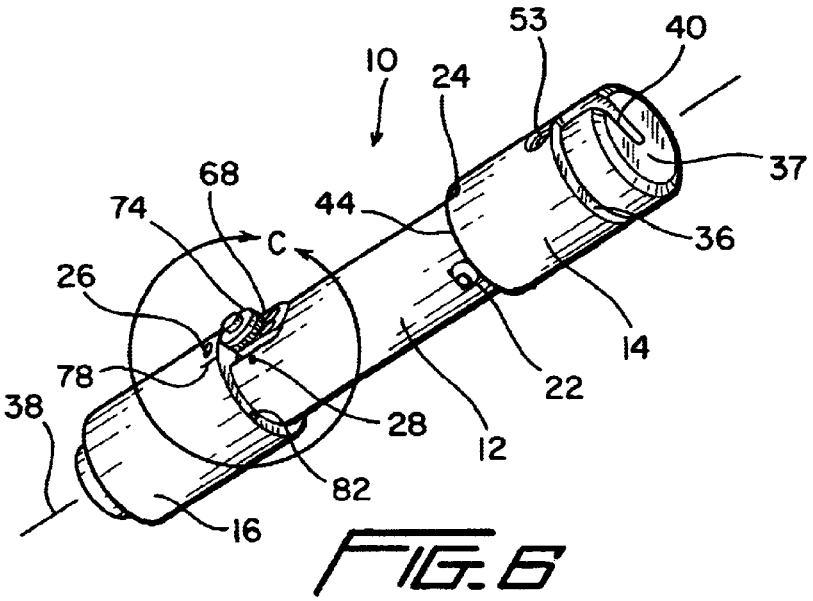
FIG. 6 is a perspective view similar to that of FIG. 2 showing, however, the new and improved manually-operated wire twisting and tying tool or device as viewed from the opposite lateral side of the tool or device of the present invention and showing the cooperative parts thereof.

More particularly, as can best be seen or appreciated from FIGS. 2, 4 and 6, the axially inner end of the first wire-twisting housing section or handle 14 is adapted to be mounted upon or over the first axial end of the axially central main housing section 12 in an enveloping manner such that the first wire-gripping mechanism or implement 18 extends into and is axially disposed within the interior portion of the first axial end of the axially central main tubular housing section 12. In order to fixedly secure the first wire-twisting housing section or handle 14 and the first wire-gripping mechanism or implement 18 upon and within the first axial end of the axially central main tubular housing section 12, respectively, a first suitable fastener 22, as best seen in FIG. 6, is inserted through suitable apertures, not shown, respectively formed within the first axial end of the axially central main tubular housing section 12 and the first wire-gripping mechanism or implement 18 so as to fixedly secure the first wire-gripping mechanism or implement 18 within the first axial end of the axially central main tubular housing section 12. In a similar manner, a second suitable fastener 24, as best seen in FIGS. 4 and 6, is inserted through suitable apertures, not shown, respectively formed within the first wire-twisting housing section or handle 14 and the first wire-gripping mechanism or implement 18 so as to fixedly secure the first wire-twisting housing section or handle 14 and the first wire-gripping mechanism or implement 18 together.

Figure 7:
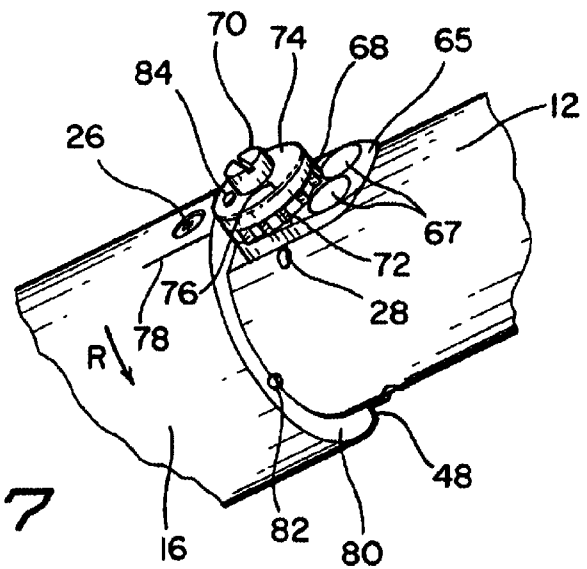
FIG. 7 is an enlarged view of the encircled area C as noted upon FIG. 6 showing in greater detail the rotatable gauge member, rotatably mounted upon the end of the axially central main housing section which is disposed adjacent to the rotatable end of the new and improved manually-operated wire twisting and tying tool of the present invention, for effectively indicating or monitoring the number of revolutions of the rotatable end of wire twisting and tying tool, with respect to the fixed end of the wire twisting and tying tool, such that the tool can impress or form a predetermined number of twists upon or within the pair of wires that are to be twisted and tied together.

As can best be appreciated from FIGS. 4, 6, and 7, in order to rotatably secure the second wire-twisting housing section or handle 16 and the second wire-gripping mechanism or implement 20 upon and within the second axial end of the axially central main tubular housing section 12, respectively, a suitable fastener 26 is inserted through suitable apertures, not shown, respectively formed within the second wire-twisting housing section or handle 16 and the second wire-gripping mechanism or implement 20 so as to fixedly secure the second wire-gripping mechanism or implement 20 within the second wire-twisting housing section or handle 16. In addition, an outer peripheral wall portion of the second wire-gripping mechanism or implement 20 is provided with a circumferentially extending recessed portion or groove, not shown, and a suitable set screw or pin 28 is inserted through a side-wall portion of the second axial end of the axially central main tubular housing section 12 which is disposed adjacent to the second wire-twisting housing section or handle 16 so as to effectively engage the circumferentially extending recessed portion or groove, not shown, defined within the outer peripheral wall portion of the second wire-gripping mechanism or implement 20.

In this manner, the assembly comprising the second wire-twisting housing section or handle 16 and the second wire-gripping mechanism or implement 20 is axially locked or retained within the second axial end of the axially central main tubular housing section 12. However, such assembly comprising the second wire-twisting housing section or handle 16 and the second wire-gripping mechanism or implement 20 is nevertheless permitted to undergo rotational movement with respect to the axially central main tubular housing section 12, and more importantly, with respect to the first wire-gripping mechanism or implement 18 fixedly mounted within the assembly comprising the first axial end of the axially central main tubular housing section 12 and the first wire-twisting housing section or handle 14.

Figure 8:
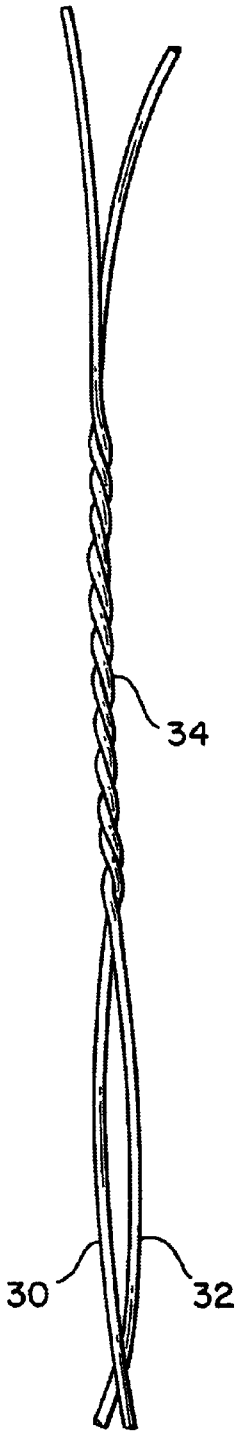
FIG. 8 is a front elevational view of a pair of baling wires twisted and tied together by means of the new and improved manually-operated wire twisting and tying tool or device illustrated within FIGS. 2–7.

In order to insert a pair of wires, as shown as 30 and 32 in FIG. 8, into the new and improved manually operated wire twisting and tying tool or device 10 of the present invention, and in order to further properly axially dispose the wires 30,32 within the tool or device 10 such that a wire twisting and tying operation can be properly performed upon the wires 30,32 in order to achieve, for example, a twelve-loop twist and tie section within the wires 30,32, as disclosed at 34 in FIG. 8, the new and improved manually operated wire twisting and tying tool or device 10 of the present invention is provided with additional unique structure. With reference again being made to FIGS. 2, 3, and 6, the first wire-twisting housing section or handle 14 is provided with a first radially inwardly extending slot or groove 36 which is oriented within a radial plane which is perpendicular to the longitudinal axis of the hand-held device or tool 10. As can readily be appreciated from FIGS. 2, 3, and 6, the slot or groove 36 is located at an axial position which is located axially inwardly from an end face 37 of the first wire-twisting housing section or handle 14 and extends radially inwardly from the outer peripheral surface of the first wire-twisting housing section or handle 14 to, and even slightly beyond, the longitudinal axis 38 of the tool or device 10.

In addition, as can best be seen from FIG. 6, the first wire-twisting housing section or handle 14 is further provided with a second radially inwardly extending slot or groove 40 which is oriented within an axial plane which is parallel to the longitudinal axis of the hand-held device or tool 10. The second radially inwardly extending slot or groove 40 extends axially from the end face 37 of the first wire-twisting housing section or handle 14 to the first radially inwardly extending slot or groove 36 so as to intersect the first radially inwardly extending slot or groove 36, and also extends radially inwardly from the outer peripheral surface of the first wire-twisting housing section or handle 14 to, and even slightly beyond, the longitudinal axis 38 of the tool or device 10. As may be additionally appreciated from FIGS. 2, 3, and 6, if the end face 37 of the first wire-twisting housing section or handle 14 is the face of a clock, the slot or groove 40 commences radially inwardly from the nine o'clock position thereof.

In a similar manner, the first wire-twisting housing section or handle 14 is provided with a third radially inwardly extending slot or groove 42 which is likewise oriented within an axial plane which is parallel to the longitudinal axis of the hand-held device or tool 10. The third radially inwardly extending slot or groove 42 extends axially from the end 44 of the first wire-twisting housing section or handle 14, which is disposed opposite the end face 37, to the first radially inwardly extending slot or groove 36 so as to likewise intersect the first radially inwardly extending slot or groove 36. In addition, third radially inwardly extending slot or groove 42 also extends radially inwardly from the outer peripheral surface of the first wire-twisting housing section or handle 14 to, and even slightly beyond, the longitudinal axis 38 of the tool or device 10. With respect to the end face 37 of the first wire-twisting housing section or handle 14, and again considering the same to be the face of a clock, it may be additionally appreciated from FIGS. 2, 3, and 6 that the third radially inwardly extending slot or groove 42 commences radially inwardly from the three o'clock position thereof. It can therefore be appreciated further that the second radially inwardly extending slot or groove 40 and the third radially inwardly extending slot or groove 42 are effectively connected to each other through the intermediary of the first radially inwardly extending slot or groove 36 for a purpose which will be explained more fully shortly hereinafter.

Continuing further, and as can best be appreciated from FIG. 2, it is additionally seen that the axially central main tubular housing section 12 is provided with an axially oriented slot 46 which is defined within a peripheral side wall thereof, and that the second rotatable wire-twisting housing section or handle 16 is provided with a fourth axially oriented, radially inwardly extending slot or groove 48 which is similar to the third axially oriented, radially inwardly extending slot or groove 42 as defined within the first fixed wire-twisting housing section or handle 14. Still yet further, the first and second wire-gripping mechanisms or implements 18,20 are respectively provided with fifth and sixth axially oriented, radially inwardly extending slots or grooves 50,52 which are also similar to the third and fourth axially oriented, radially inwardly extending slots or grooves 42,48 as defined within the first fixed and second rotatable wire-twisting housing sections or handles 14,16. More particularly, it can be further appreciated that when the first fixed wire-twisting housing section or handle 14 is assembled together with the axially central main tubular housing section 12 and the first wire-gripping mechanism or implement 18, the third and fifth axially oriented slots 42 and 50 of the first fixed wire-twisting housing section or handle 14 and the first wire-gripping mechanism or implement 18 are respectively coaxially aligned with respect to each other. In a similar manner, when the assembly comprising the second rotatable wire-twisting housing section or handle 16 and the second wire-gripping mechanism or implement 20 are disposed at a predetermined circumferentially rotatable START position in preparation for the initiation or commencement of a wire-twisting and tying operation or procedure, as will be discussed more fully hereinafter, the fourth and sixth axially oriented slots 48 and 52 of the second rotatable wire-twisting housing section or handle 16 and the second wire-gripping mechanism or implement 20 will be respectively coaxially aligned with respect to the third and fifth axially oriented slots 42 and 50 of the first fixed wire-twisting housing section or handle 14 and the first wire-gripping mechanism or implement 18. In this manner, a single continuous axially oriented slot, comprising third, fifth, sixth, and fourth slot portions or components 42,50,52,48, is effectively defined throughout substantially the entire longitudinal extent or length of the tool or device 10.

In operation, when the pair of wires 30,32, as are shown in FIG. 8, are to be twisted and tied together so as to form the twisted or knotted portion 34 as is also illustrated within FIG. 8, the pair of wires 30,32 are initially radially inserted into the first radially inwardly extending slot or groove 36 such that the longitudinal extents or axes of the wires 30,32 are substantially perpendicular to the longitudinal axis 38 of the tool or device 10. Due to the aforenoted effective interconnection of the second and third axially oriented, radially inwardly extending slots or grooves 40,42, formed within diametrically opposite sides of the first fixed wire-twisting housing section or handle 14, as facilitated by means of the intermediary first radially inwardly extending slot or groove 36, the tool or device 10 is then able to be pivoted 90° from its original disposition or orientation such that relatively short or minor sections of the pair of wires 30,32 will now be disposed within the second axially oriented slot or groove portion 40 while the relatively long or major free end portions of the wires 30, 32 will now be disposed coaxially within the aforenoted single continuous or common axially oriented slot defined by means of the third, fifth, sixth, and fourth axially oriented slot portions or components 42,50,52,48. The free ends of the wires 30,32 may be axially pulled through the slots 42, 50,52,48 50 as to effectively render the same taut and without any slack, and in order to effectively grip the wires 30,32 and prevent the same from loosening around the bale, a pair of rubber plugs 51 are fixedly secured within slots 40 and 42 by means of set screws 53 which are inserted into the first fixed wire-twisting housing section or handle 14 from opposite diametrical positions thereof, although only the rubber plug 51 which is secured within slot 42 is visible in FIGS. 2 and 3.

Figure 5:
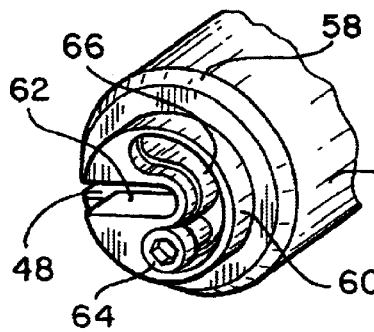
FIG. 5 is an enlarged view of the encircled area B as noted upon FIG. 4 showing in greater detail the disposition of the rotatable cap member rotatably disposed within the rotatable end of the new and improved manually-operated wire twisting and tying tool of the present invention for effectively closing the rotatable end of the axially oriented wire accommodation slot so as to prevent the inadvertent disengagement of the wires from the axially oriented wire accommodation slot.
Figure 1:
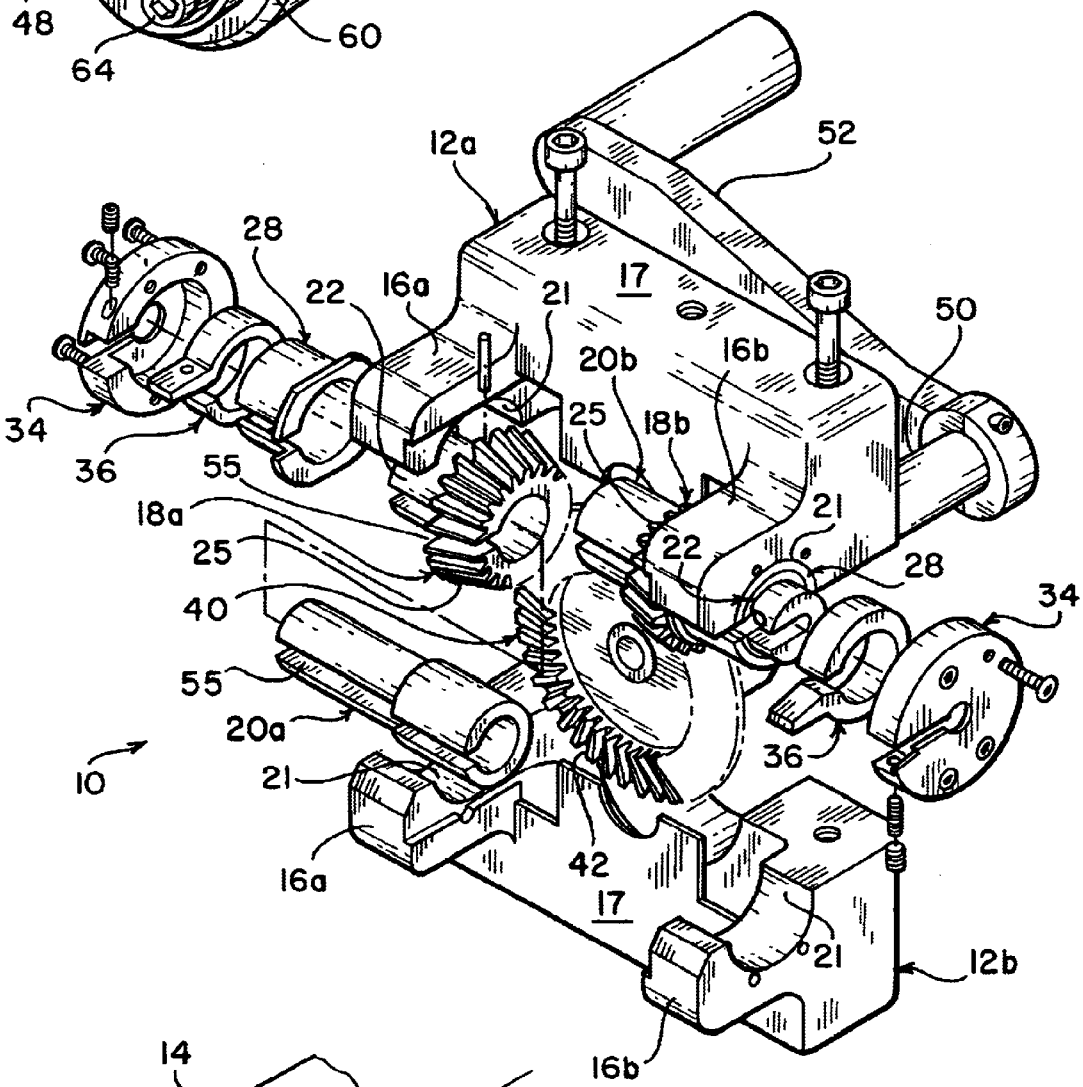
FIG. 1 (PRIOR ART)
FIG. 1 is an exploded perspective view of a conventional PRIOR ART hand-operable bale wire twisting and tying apparatus.

It is noted further that each one of the first and second wire-gripping mechanisms or implements 18,20 is provided with suitable wire-engaging means 54,56, which may be, for example, similar to the staggered pins 60*a*,60*b* as disclosed within the aforenoted U.S. Pat. No. 5,921,289 to Johnson, and in this manner, the axially central portions of the wires 30,32 are respectively properly and securely retained and oriented within the first and second wire-gripping mechanisms or implements 18,20 in preparation for the wire-twisting and tying operation or procedure to be subsequently performed thereon. In order to effectively close the end 58 of the tool or device 10, which is disposed opposite the wire-insertion end thereof, so as to effectively prevent the free end portions of the wires 30,32 from becoming dislodged from their axially oriented captured positions within the axially oriented third, fifth, sixth, and fourth slot portions or components 42,50,52,48 of the tool or device 10 during a wire-twisting and tying operation, the second rotatable wire-twisting housing section or handle 16 has a cap member 60 rotatably mounted within the end face thereof as best seen in FIGS. 4 and 5. The cap member 60 is provided with an axially oriented, radially inwardly extending slot 62 which is alternatively capable of being aligned or non-aligned with respect to the fourth axially oriented slot portion 48 as defined within the second rotatable wire-twisting housing section or handle 16.

When the cap member 60 is rotated to a first position as shown in FIGS. 4 and 5, the axially oriented slots 25 62,48 of the cap member 60 and second rotatable wire-twisting housing section or handle 16 are aligned with respect to each other so as to permit radial insertion of the wires 30, 32 therewithin. When, however, the cap member 60 is rotated with respect to the second rotatable wire-twisting housing section or handle 16 through a clockwise angular rotation of, for example, 180°, as viewed in FIGS. 4 and 5, axially oriented slot 62 of cap member 60 will no longer be aligned with slot 48 of second rotatable wire-twisting housing section or handle 16 whereby the free end portions of the wires 30,32 will effectively be prevented from becoming dislodged or withdrawn from the slot 48 of the second rotatable wire-twisting housing section or handle 16. Upon completion of the wire twisting and tying operation, the cap member 60 can be rotated in the counterclockwise direction back to its original position whereby slot 62 is again aligned with slot 48 of second rotatable wire-twisting housing section or handle 16 such that the completed wires 30,32 can be removed from the tool or device 10. In order to define the extreme limits to which the cap member 60 can be rotated in the aforenoted clockwise and counterclockwise directions so as to in turn define the slot alignment and non-alignment positions, a shoulder bolt 64 is fixedly mounted within the end face of the second rotatable wire-twisting housing section or handle 16, and the cap member 60 is provided with an arcuately configured slot or groove 66. Accordingly, when the cap member 60 is disposed at the illustrated extreme position corresponding to or defining the alignment position of the slot portions 48,62, a first end portion of the arcuate groove or slot 66 will encounter the shoulder bolt 64, whereas when the cap member 60 is rotated to its other extreme position corresponding to or defining the non-alignment position of the slot portions 48,62, a second opposite end portion of the arcuate groove or slot 66 will encounter the shoulder bolt 64.

With reference lastly being made to FIGS. 4, 6, and 7, a last unique feature of the new and improved manually-operated wire twisting and tying tool or device 10 of the present invention resides in the provision of a visual indicating mechanism or gauge means for ensuring that a predetermined number of twists have been impressed upon or imparted to the wires 30,32 during a particular wire twisting and tying operation or procedure. In this manner, the operator can be assured that the twelve-loop twist and tie section within the wires 30,32, as disclosed at 34 in FIG. 8, has in fact been achieved.

More particularly, a mounting plate 65 is fixedly mounted upon an end portion of the axially central main housing section 12 by means of a plurality of fasteners 67, and a gear member 68 is rotatably mounted upon the plate 65 by means of a suitable fastener 70 so as to be disposed adjacent to the second rotatable wire-twisting housing section or handle 16. The gear member 68 is provided with, for example, twelve teeth 72 upon the external circumferential periphery thereof, wherein the teeth 72 are equiangularly spaced apart through means of an angular spacing of 30°. An indicator plate 74 is fixedly mounted atop the gear member 68, and a first, diametrically extending scribe line 76 is provided upon the upper surface of the indicator plate 74. A second scribe line 78 is provided upon the second rotatable wire-twisting housing section or handle 16 at a circumferential position which is adjacent to fastener 26 and which is effectively located 180° away from or opposite the axially oriented slot 48 of the second rotatable wire-twisting housing section or handle 16. The axially inner end face 80 of the second rotatable wire-twisting housing section or handle 16 is provided with an engagement pin 82 which is circumferentially interposed between the axially oriented slot 48 and the second scribe line 78 so as to be located at a circumferential position upon the second rotatable wire-twisting housing section or handle 16 which is effectively 90° ahead of the circumferential position at which the second scribe line 78 is located as considered in the direction of rotation R of the second rotatable wire-twisting housing section or handle 16. The engagement pin 82 is adapted to successively engage the individual gear teeth 72 of the gear member 68 each time the second rotatable wire-twisting housing section or handle 16, and its operatively associated second wire-gripping implement or mechanism 20, complete a revolution around the longitudinal axis 38 of the tool or device 10 relative to the first fixed wire-twisting housing section or handle 14, and its operatively associated first wire-gripping mechanism or implement 18, during the performance of a wire twisting and tying operation or procedure, for a purpose which will be discussed more fully hereinafter.

More particularly, as has been briefly noted hereinbefore, when a wire twisting and tying operation or procedure is to be performed, the second rotatable wire-twisting housing section or handle 16, and its operatively associated second wire-gripping mechanism or implement 20, are initially rotated around longitudinal axis 38 so as to be disposed at a START position such that the slot portions 48,52 of the second rotatable wire-twisting housing section or handle 16, and its operatively associated second wire-gripping mechanism or implement 20, will be coaxially aligned with the slot portions 42,50 of the first fixed wire-twisting housing section or handle 14 and its operatively associated first wire-gripping mechanism or implement 18. At this point in time, the first scribe line 76 of the indicator plate 74 should also be co-linearly aligned with respect to the second scribe line 78 of the second rotatable wire-twisting housing section or handle 16, however, if the angular disposition or orientation of the gear and indicator plate members 68,74 is such that the first scribe line 76 of the indicator plate 74 is not aligned or disposed in a co-linear manner with respect to the second scribe line 78 of the second rotatable wire-twisting housing section or handle 16, the gear and indicator plate members 68,74 may be manually rotated until the first and second scribe lines 76,78 are in fact aligned in a co-linear manner with respect to each other.

It is to be noted that, in connection with the mounting of the gear and indicator plate assembly 68,74 upon the mounting plate 65, a spring-biased plunger mechanism 84 passes downwardly through the indicator plate and gear assembly 74,68 and has a ball member, not shown, mounted upon the lower end portion thereof. In turn, an upper surface portion of the mounting plate 65 is provided with a circumferential array of detents or recesses, also not shown, for respectively or successivley accommodating the ball member of the plunger mechanism 84. Consequently, as the gear member 68 is rotated in, for example, the counterclockwise direction as viewed in FIGS. 6 and 7, as a result of the second rotatable wire-twisting housing section or handle 16 being rotated in the direction denoted by the arrow R whereby the engagement pin 82 successively engages the individual teeth 72 of the gear member 68, the ball and detent members will permit the gear and indicator plate assembly 68,74 to be serially moved in a circumferential manner to, and retained at, successive angular positions which can be readily visually determined, perceived, or appreciated by means of an operator as a result of the relative angular disposition of the first scribe line 76 of the plate member 74 with respect to the second scribe line 78 of the second rotatable wire-twisting housing section or handle 16.

Accordingly, and more particularly, when the gear and indicator plate assembly 68,74 has in fact been manually rotated to its START position at which the first and second scribe lines 76,78 of the indicator plate 74 and second rotatable wire-twisting housing section or handle 16 have in fact aligned with respect to each other in a co-linear manner, the engagement pin 82 is located rotationally or circumferentially beyond the gear member 68. Consequently, when the second rotatable wire-twisting housing section or handle 16, and its operatively associated second wire-gripping mechanism or implement 20, are then rotated around the longitudinal axis 38 of tool or device 10 so as to complete a first revolution with respect to the first rotatable wire-twisting housing section or handle 14, and its operatively associated first wire-gripping mechanism or implement 18, so as to impress upon, or form within, the wires 30,32 a first one of the twelve loops of the knotted or tied portion 34, the engagement pin 82 will have encountered the first gear tooth 72 of the gear member 68 so as to cause the gear member 68 to rotate through its first angular displacement of 30°. The first scribe line 76 of the indicator plate 74 will now no longer be co-linearly aligned with respect to the second scribe line 78 of the second rotatable wire-twisting housing section or handle 16, and similarly for the next consecutive four revolutions of the second rotatable wire-twisting housing section or handle 16, and its operatively associated second wire-gripping mechanism or implement 20, with respect to the first rotatable wire-twisting housing section or handle 14, and its operatively associated first wire-gripping mechanism or implement 18.

However, when the second rotatable wire-twisting housing section or handle 16, and its operatively associated second wire-gripping mechanism or implement 20, are in the process of completing their sixth revolution with respect to the first rotatable wire-twisting housing section or handle 14, and its operatively associated first wire-gripping mechanism or implement 18, and have in fact completed five and three-quarter revolutions, the engagement pin 82 will encounter the sixth tooth 72 of the gear member 68 and will accordingly cause the gear and indicator plate assembly 68, 74 to undergo an angular displacement of 180° such that the first diametrically extending scribe line 76 of the indicator plate 74 will again be disposed at its original START position. Accordingly, still further, when in fact the second rotatable wire-twisting housing section or handle 16, and its operatively associated second wire-gripping mechanism or implement 20, have in fact completed the sixth revolution with respect to the first rotatable wire-twisting housing section or handle 14, and its operatively associated first wire-gripping mechanism or implement 18, the second scribe line 78 of the second rotatable wire-twisting housing section or handle 16 will once again be co-linearly aligned with the first diametrically extending scribe line 76 disposed upon the indicator plate 74 so as to thereby indicate to the operator that the wire twisting and tying operation has in fact been completed.

Upon completion of the entire wire twisting and tying operation, it has been determined that the second rotatable wire-twisting housing section or handle 16, and its operatively associated second wire-gripping mechanism or implement 20, should be rotated an additional quarter-turn or 90°, and then rotated backwardly in a reverse or retro-grade manner or direction through means of a quarter-turn or 90°, so as to effectively twist the wires 30,32 slightly beyond the final twist or tie point and to subsequently relieve the pressure inherent within such twisted and tied section 34 whereby the wires 30,32 may then be easily removed from the first and second wire-gripping mechanisms or implements 18,20 of the tool or device 10. It is noted that as a result of the angular disposition of the engagement pin 82 upon the second rotatable wire-twisting housing section or handle 16, that is, at a circumferential position which is 90° ahead of the second scribe line 78 marked upon the second rotatable wire-twisting housing section or handle 16, then when the six revolutions of the second rotatable wire-twisting housing section or handle 16, and its operatively associated second wire-gripping mechanism or implement 20, have in fact been completed with respect to the first rotatable wire-twisting housing section or handle 14, and its operatively associated first wire-gripping mechanism or implement 18, as indicated by the co-linear alignment of the first and second scribe lines 76,78 of the indicator plate 74 and second rotatable wire-twisting housing section or handle 16, the engagement pin 82 will already be disposed circumferentially beyond the gear member 68. Accordingly, during the aforenoted additional 90° or quarter-turn revolution of the second rotatable wire-twisting housing section or handle 16, and its operatively associated second wire-gripping mechanism or implement 20, with respect to the first rotatable wire-twisting housing section or handle 14, and its operatively associated first wire-gripping mechanism or implement 18, both forwardly and backwardly, the engagement pin 82 will not encounter any of the teeth 72 of the gear member 68 so as not to alter the twisted properties of the wires 30,32 other than to perform the aforenoted final twisting and pressure relief operation. The tool or device 10 is then ready for use in conjunction with a new wire-twisting operation or procedure.

Thus, it may be seen that in accordance with the principles and teachings of the present invention, there has been disclosed a new and improved manually-operated wire twisting and tying tool or device which is relatively simple in structure and relatively small in size as to be readily grasped within, and manipulated by, the hands of an operator. The tool or device comprises two handle structures which have wire-twisting mechanisms incorporated therein and which are relatively rotatable with respect to each other so as to impress upon or form within a pair of wires a predetermined number of twists or loops dependent upon the number of revolutions that one of the handle structures, and its operatively associated wire-twisting mechanism, undergoes with respect to the other handle structure and its operatively associated wire-twisting mechanism. A gauge mechanism is also integrally incorporated upon the tool or device so as to readily indicate to an operator when the predetermined number of relative revolutions of the handles, and that of the operatively associated wire-twisting mechanisms, have been achieved.

Obviously, many variations and modifications of the present invention are possible in light of the above teachings. It is therefore to be understood that within the scope of the appended claims, the present invention may be practiced otherwise than as specifically described herein.

What is claimed as new and desired to be protected by Letters Patent of the United States of America, is:

1. A manually-operated wire twisting and tying tool for twisting and tying a pair of wires together, comprising:

a support member;

a first handle member mounted upon a first end of said support member and adapted to be grasped by one hand of an operator;

a first wire-twisting implement mounted within said first handle member;

a second handle member mounted upon a second end of said support member and adapted to be grasped by another hand of an operator;

a second wire-twisting implement mounted within said second handle member;

axially oriented slot means, extending through said support member, said first handle member, said first wire-twisting implement, said second handle member, and said second wire-twisting implement, for accommodating the pair of wires to be twisted and tied together in preparation for a wire twisting and tying operation; and a radially oriented slot oriented within a radial plane which is substantially perpendicular to said axially oriented slot means and which intersects said axially oriented slot means so as to permit the wires, that are to be twisted and tied together, to be inserted through said radially oriented slot and into said axially oriented slot means in preparation for a wire twisting and tying operation, said first and second handle members, having said first and second wire-twisting implements mounted therein, being rotatable with respect to each other such that when said first and second handle members are rotated with respect to each other, said first and second wire-twisting implements of said first and second handle members impart twists to the pair of wires so as to effectively tie the pair of wires together.

2. The manually-operated wire twisting and tying tool as set forth in claim 1, wherein:

said support member comprises an elongated tubular housing defining a longitudinal axis around which said first and second handle members are relatively rotatable with respect to each other.

3. The manually-operated wire twisting and tying tool as set forth in claim 2, wherein:

said first handle member and said first wire-twisting implement are fixedly mounted within said first end of said support housing; and said second handle member and said second wire-twisting implement are rotatably mounted within said second end of said support housing.

4. The manually-operated wire twisting and tying tool as set forth in claim 2, wherein said axially oriented slot means comprises:

a first axially oriented slot defined within said first handle member;

a second axially oriented slot defined within said first wire-twisting implement mounted within said first handle member;

a third axially oriented slot defined within said second wire-twisting implement mounted within said second handle member; and a fourth axially oriented slot defined within said second handle member;

said first, second, third, and fourth slots respectively defined within said first handle member, said first wire-twisting implement, said second wire-twisting implement, and said second handle member being axially alignable with respect to each other so as to define together a single axially oriented slot extending throughout substantially the entire length of said tool so as to house and accommodate the pair of wires to be twisted and tied together in preparation for a wire twisting and tying operation.

5. The manually-operated wire twisting and tying tool as set forth in claim 4, further comprising:

a cap member, having a fifth axially oriented slot defined therein, rotatably mounted upon said second handle member for movement between a first position at which said fifth axially oriented slot of said cap member is axially aligned with said single axially oriented slot extending throughout substantially the entire length of said tool so as to permit insertion of the pair of wires into said single axially oriented slot extending throughout substantially the entire length of said tool in preparation for the performance of a wire twisting and tying operation, and a second position at which said fifth axially oriented slot of said cap member is axially non-aligned with said single axially oriented slot extending throughout substantially the entire length of said tool so as to prevent withdrawal of the pair of wires from said single axially oriented slot extending throughout substantially the entire length of said tool during the performance of a wire twisting and tying operation.

6. The manually-operated wire twisting and tying tool as set forth in claim 5, wherein:

a pin is fixedly mounted within an end portion of said second handle member; and an arcuately shaped slot is defined within said cap member for operative engagement with said pin fixedly mounted within said end portion of said second handle member such that opposite ends of said arcuately shaped slot define said first and second positions.

7. The manually-operated wire twisting and tying tool as set forth in claim 4, wherein:

said first axially oriented slot is defined upon one lateral side of said first handle member;

a sixth axially oriented slot is defined upon an opposite lateral side of said first handle member; and said radially oriented slot is defined within said first handle member so as to interconnect said first and sixth axially oriented slots so as to permit the wires, that are to be twisted and tied together, to be inserted into said single axially oriented slot extending throughout substantially the entire length of said tool in preparation for a wire twisting and tying operation.

8. A manually-operated wire twisting and tying tool for twisting and tying a pair of wires together, comprising:

a support member defining a longitudinal axis;

a first handle member mounted upon a first end of said support member and adapted to be grasped by one hand of an operator;

a first wire-twisting implement mounted within said first handle member;

a second handle member mounted upon a second end of said support member and adapted to be grasped by another hand of an operator;

a second wire-twisting implement mounted within said second handle member, said first and second handle members, having said first and second wire-twisting implements mounted therein, being rotatable with respect to each other around said longitudinal axis such that when said first and second handle members are rotated with respect to each other, said first and second wire-twisting implements of said first and second handle members impart twists to the pair of wires so as to effectively tie the pair of wires together; and visual indicating means for indicating to an operator when a predetermined plural number of revolutions between said first and second handle members, and said first and second wire-twisting implements mounted therein, has been completed so as to ensure the proper twisting and tying together of the pair of wires.

9. The manually-operated wire twisting and tying tool as set forth in claim 8, wherein:

said second handle member is rotatably mounted upon said support member around said longitudinal axis;

a plate member is rotatably mounted upon said support member; and said visual indicating means comprises a first scribe line defined upon said plate member, and a second scribe line defined upon said second handle member such that when a wire twisting operation is being initiated, said first and second scribe lines will be co-linearly aligned with each other, and when said wire twisting operation is completed, said first and second scribe lines will again be co-linearly aligned with each other.

10. The manually-operated wire twisting and tying tool as set forth in claim 9, further comprising:

a gear member, upon which said plate member is fixedly mounted, rotatably mounted upon said support member and comprising a plurality of circumferentially spaced gear teeth; and an engagement pin mounted upon said second handle member for successively engaging said gear teeth of said gear member as said second handle member is rotated around said longitudinal axis so as to rotate said gear member, and said plate member fixedly mounted thereon, a predetermined angular extent so as to again cause co-linear alignment of said first and second scribe lines defined upon said plate member and said second handle member thereby indicating com-pletion of the wire twisting and tying operation.

11. The manually-operated wire twisting and tying tool as set forth in claim 10, wherein:

said first scribe line defined upon said plate member extends diametrically across said plate member; and said gear teeth formed upon said gear member are circumferentially spaced through angular extents of 30° whereupon said first and second scribe lines of said plate member and said second handle member will be aligned with respect to each other after six revolutions of said second handle member around said longitudinal axis which causes said plate member to undergo a rotational movement comprising 180°.

12. The manually-operated wire twisting and tying tool as set forth in claim 8, wherein:

said support member comprises an elongated tubular housing defining said longitudinal axis around which said first and second handle members are relatively rotatable with respect to each other.

13. The manually-operated wire twisting and tying tool as set forth in claim 12, wherein:

said first handle member and said first wire-twisting implement are fixedly mounted within said first end of said support housing; and said second handle member and said second wire-twisting implement are rotatably mounted within said second end of said support housing.

14. The manually-operated wire twisting and tying tool as set forth in claim 12, wherein:

a first axially oriented slot is defined within said first handle member;

a second axially oriented slot is defined within said first wire-twisting implement mounted within said first handle member;

a third axially oriented slot is defined within said second wire-twisting implement mounted within said second handle member; and a fourth axially oriented slot is defined within said second handle member;

said first, second, third, and fourth slots respectively defined within said first handle member, said first wire-twisting implement, said second wire-twisting implement, and said second handle member being axially alignable with respect to each other so as to define together a single axially oriented slot extending throughout substantially the entire length of said tool so as to house and accommodate the pair of wires to be twisted and tied together in preparation for a wire twisting and tying operation.

15. The manually-operated wire twisting and tying tool as set forth in claim 14, further comprising:

a cap member, having a fifth axially oriented slot defined therein, rotatably mounted upon said second handle member for movement between a first position at which said fifth axially oriented slot of said cap member is axially aligned with said single axially oriented slot extending throughout substantially the entire length of said tool so as to permit insertion of the pair of wires into said single axially oriented slot extending throughout substantially the entire length of said tool in preparation for the performance of a wire twisting and tying operation, and a second position at which said fifth axially oriented slot of said cap member is axially non-aligned with said single axially oriented slot extending throughout substantially the entire length of said tool so as to prevent withdrawal of the pair of wires from said single axially oriented slot extending throughout substantially the entire length of said tool during the performance of a wire twisting and tying operation.

16. The manually-operated wire twisting and tying tool as set forth in claim 15, wherein:

a pin is fixedly mounted within an end portion of said second handle member; and an arcuately shaped slot is defined within said cap member for operative engagement with said pin fixedly mounted within said end portion of said second handle member such that opposite ends of said arcuately shaped slot define said first and second positions.

17. The manually-operated wire twisting and tying tool as set forth in claim 14, wherein:

said first axially oriented slot is defined upon one lateral side of said first handle member;

a sixth axially oriented slot is defined upon an opposite lateral side of said first handle member; and a radially oriented slot is defined within said first handle member so as to interconnect said first and sixth axially oriented slots so as to permit the wires, that are to be twisted and tied together, to be inserted into said single axially oriented slot extending throughout substantially the entire length of said tool in preparation for a wire twisting and tying operation.

18. A method of twisting and tying a pair of wires together, by using a manually-operated wire twisting and tying tool, comprising the steps of:

providing a support member;

mounting a first handle member, adapted to be grasped by one hand of an operator, upon a first end of said support member;

providing a first wire-twisting implement within said first handle member;

mounting a second handle member, adapted to be grasped by another hand of an operator, upon a second end of said support member;

providing a second wire-twisting implement within said second handle member;

providing axially oriented slot means, that extends through said support member, said first handle member, said first wire-twisting implement, said second handle member, and said second wire-twisting implement, for accommodating the pair of wires to be twisted and tied together in preparation for a wire twisting and tying operation;

providing a radially oriented slot that is oriented within a radial plane which is substantially perpendicular to said axially oriented slot means and which intersects said axially oriented slot means;

inserting the pair of wires, that are to be twisted and tied together, into said radially oriented slot;

pivoting said tool such that the pair of wires to be twisted and tied together are effectively transferred from said radially oriented slot to said axially oriented slot means in preparation for a wire twisting and tying operation; and rotating said first and second handle members, having said first and second wire-twisting implements mounted therein, with respect to each other such that said first and second wire-twisting implements of said first and second handle members impart twists to the pair of wires so as to effectively tie the pair of wires together.

19. The method as set forth in claim 18, wherein said step of providing said axially oriented slot means further comprises the steps of:

providing a first axially oriented slot within said first handle member;

providing a second axially oriented slot within said first wire-twisting implement mounted within said first handle member;

providing a third axially oriented slot within said second wire-twisting implement mounted within said second handle member; and providing a fourth axially oriented slot within said second handle member such that said first, second, third, and fourth slots respectively defined within said first handle member, said first wire-twisting implement, said second wire-twisting implement, and said second handle member are axially alignable with respect to each other so as to define together a single axially oriented slot extending throughout substantially the entire length of said tool so as to house and accommodate the pair of wires to be twisted and tied together in preparation for a wire twisting and tying operation.

20. The method as set forth in claim 19, further comprising the steps of:

forming said first axially oriented slot within one lateral side of said first handle member;

forming a fifth axially oriented slot within an opposite lateral side of said first handle member; and forming said radially oriented slot within said first handle member so as to interconnect said first and fifth axially oriented slots.

21. The method as set forth in claim 19, further comprising the step of:

rotatably mounting a cap member, having a sixth axially oriented slot defined therein, upon said second handle member for movement between a first position at which said sixth axially oriented slot of said cap member is axially aligned with said single axially oriented slot extending throughout substantially the entire length of said tool so as to permit insertion of the pair of wires into said single axially oriented slot extending throughout substantially the entire length of said tool in preparation for the performance of a wire twisting and tying operation, and a second position at which said sixth axially oriented slot of said cap member is axially non-aligned with said single axially oriented slot extending throughout substantially the entire length of said tool so as to prevent the withdrawal of the pair of wires from said single axially oriented slot extending throughout substantially the entire length of said tool during the performance of a wire twisting and tying operation.

* * * * *